US006424245B1

(12) United States Patent
Rector et al.

(10) Patent No.: US 6,424,245 B1
(45) Date of Patent: Jul. 23, 2002

(54) MAGNETIC DETENT DEVICE

(75) Inventors: Stephen W. Rector, Metamora; Glenda D. Tullis, Peoria, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/666,404

(22) Filed: Sep. 20, 2000

Related U.S. Application Data

(60) Provisional application No. 60/221,727, filed on Jul. 31, 2000.

(51) Int. Cl.[7] ..... H01F 7/08
(52) U.S. Cl. ..... 335/220; 74/527
(58) Field of Search ..... 74/527, 531; 335/253, 335/272–274, 280

(56) References Cited

U.S. PATENT DOCUMENTS

| | | | | |
|---|---|---|---|---|
| 2,525,846 A | | 10/1950 | Wilson | |
| 2,983,121 A | | 5/1961 | Naas | |
| 3,786,693 A | | 1/1974 | Keipert | |
| 3,934,216 A | * | 1/1976 | Ward | 335/253 |
| 4,132,128 A | | 1/1979 | Roggenkamp | |
| 4,539,862 A | | 9/1985 | Caldwell | |
| 5,014,030 A | | 5/1991 | Aston | |
| 5,058,451 A | | 10/1991 | Fujimoto et al. | |
| 5,499,553 A | | 3/1996 | Schott et al. | |
| 5,743,146 A | | 4/1998 | Oesterle et al. | |

* cited by examiner

*Primary Examiner*—Lincoln Donovan
(74) *Attorney, Agent, or Firm*—Clifton G. Green

(57) ABSTRACT

Apparatus and methods for restricting movement of a device. The detent device includes a housing, and a magnetic device, the magnetic device exerting a magnetic force and including a body and one of a recess defined therein and a protrusion. A magnetic body is located at least partially within the housing and is biased towards the magnetic device as a function of the magnetic force. The magnetic body includes a magnetic mass and the other of the recess defined therein and the protrusion, the other of the protrusion and the recess receiving the one of the protrusion and the recess of the magnetic device when the magnetic body is in a first predetermined position relative to the magnetic device. The magnetic mass of the magnetic body is spaced a first distance from the body of the magnetic device when the magnetic body is in the first predetermined position, and the magnetic mass of the magnetic body is spaced a second predetermined distance from the body of the magnetic device by the protrusion on the one of the magnetic device and the magnetic body when the magnetic body is in a second predetermined position relative to the magnetic device.

19 Claims, 1 Drawing Sheet

MAGNETIC DETENT DEVICE

CROSS-REFERENCE TO RELATED APPLICATION

This application claims the benefit of the U.S. Provisional Applications Ser. No. 60/221,727, filed Jul. 31, 2000.

TECHNICAL FIELD

This invention relates generally to a detent device, and more particularly to a detent device using a magnetic field.

BACKGROUND

Conventional detent devices typically rely on strictly mechanical means, such as a ball and socket. The ball is usually affixed to a moveable body, e.g. a lever, while the socket is located on a fixed body, or vice versa. When the moveable body rotates into an appropriate position, e.g., a detent position, the ball falls into the socket. The ball is typically spring loaded so as to remain in the socket until a force sufficient to compress the spring is exerted on the moveable body, freeing the moveable body from the detent position.

It is often desirable to have the lever be self-centering. Accordingly, various centering devices, such as springs, are often attached to the lever.

It is further often desirable to have the lever remain in the detent position until a certain event occurs, and then have the lever self-center. Unfortunately, this typically requires some type of mechanical device to "kick out" the lever from the detent position. These devices are often complex, expensive, and prone to malfunction.

SUMMARY OF THE INVENTION

The present invention provides apparatus and methods for restricting movement of a device. The detent device includes a housing, and a magnetic device, the magnetic device exerting a magnetic force and including a body and one of a recess defined therein and a protrusion. A magnetic body is located at least partially within the housing and is biased towards the magnetic device as a function of the magnetic force. The magnetic body includes a magnetic mass and the other of the recess defined therein and the protrusion, the other of the protrusion and the recess receiving the one of the protrusion and the recess of the magnetic device when the magnetic body is in a first predetermined position relative to the magnetic device. The magnetic mass of the magnetic body is spaced a first distance from the body of the magnetic device when the magnetic body is in the first predetermined position, and the magnetic mass of the magnetic body is spaced a second predetermined distance from the body of the magnetic device by the protrusion on the one of the magnetic device and the magnetic body when the magnetic body is in a second predetermined position relative to the magnetic device.

DETAILED DESCRIPTION

Figure 1A:
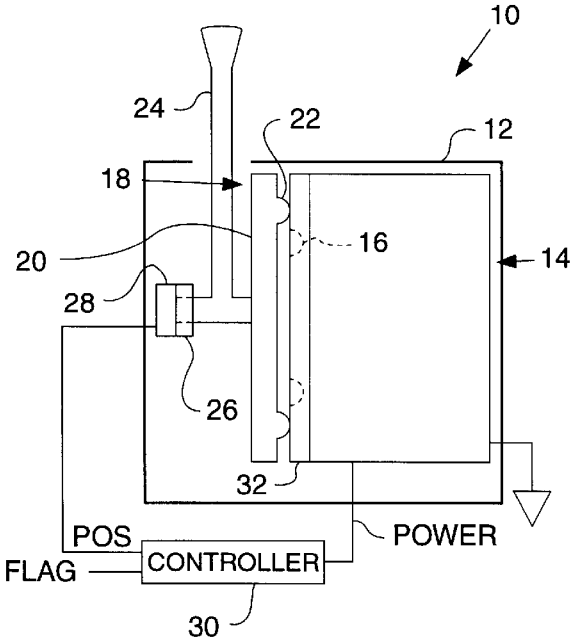
FIG. 1*a* is a cut away view from a first perspective of a detent device in a first position according to one embodiment of the invention.
Figure 1B:
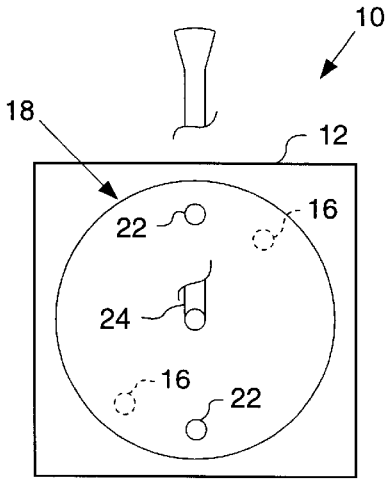
FIG. 1*b* is a cut away view from a second perspective of a detent device in a first position according to one embodiment of the invention.

FIGS. 1*a* and 1*b* are cut away views of a detent device 10 in a first position according to one embodiment of the invention. FIG. 1*a* shows the detent device 10 from a first perspective while FIG. 1*b* shows the detent device 10 from a second perspective. The detent device 10 includes a housing 12 and a magnetic device 14, such as an electromagnetic or a permanent magnet, that exerts a magnetic force, disposed at least in part within the housing 12. The magnetic device 14 also includes a recess 16, such as a dimple.

A magnetic body 18 is also disposed at least in part within the housing 12. The magnetic body 18 includes a magnetic mass 20 made of any of a variety of magnetic materials known to those skilled in the art and a protrusion, such as a knob 22 that may be mated with the recess 16. The knob 22 may be made of the same magnetic material as the magnetic mass 20, or it may be made of a different material, magnetic or not. In one embodiment of the invention, the magnetic body 18 is in the shape of a disk, although other shapes known to those skilled in the art may also be used.

In operation, in the first, non-detent position, the magnetic body 18 contacts the magnetic device 14 via the knob 22, with the magnetic mass 20 being spaced from the magnetic device by a first distance, such as the magnitude that the knob 22 protrudes. When the magnetic device 14 exerts the magnetic force, the magnetic mass 20 is biased towards, e.g., attracted, to the magnetic device 14. The magnetic force creates a friction having a first magnitude between the knob 22 and the magnetic device 14, resisting movement, such as rotation, of the magnetic body 18 relative to the magnetic device 14. The gap between the magnetic body 18 and the magnetic device 14 maintains the magnetic force acting on the magnetic body 18 to a relatively low level.

Figure 2A:
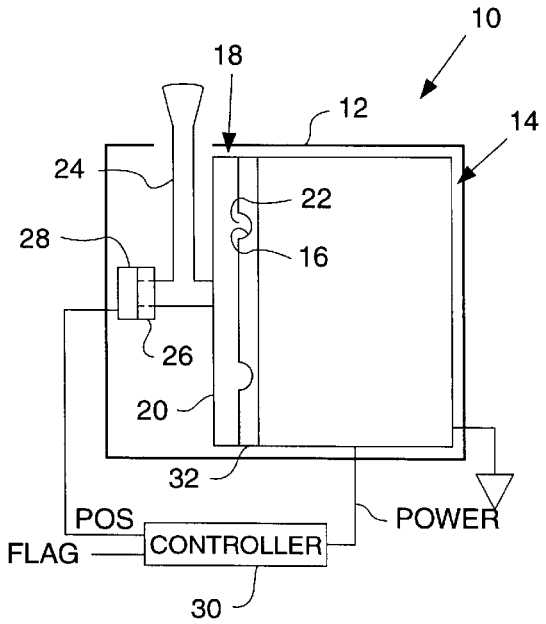
FIG. 2*a* is a cut away view from a first perspective of a detent device in a second position according to one embodiment of the invention.
Figure 2B:
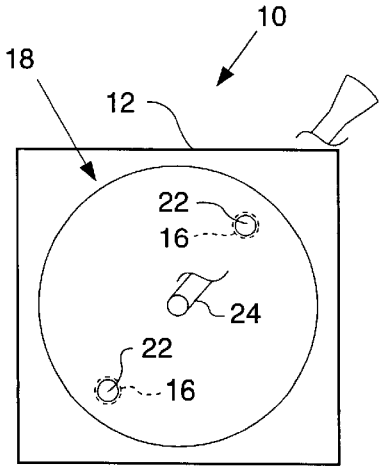
FIG. 2*b* is a cut away view from a second perspective of a detent device in a second position according to one embodiment of the invention.

As shown in FIG. 2, as the magnetic body 18 rotates, the knob 22 aligns with the recess 16. The magnetic force pulls the magnetic body 18 towards the magnetic device 14, mating the knob 22 with the recess 16. Typically, the magnetic body 18 is no longer spaced apart from the magnetic device 14, or spaced apart by a second distance, usually less than a first distance above.

The magnetic force creates a friction having a second magnitude, typically greater than the first magnitude above, between the knob 22 and recess 16, and the magnetic body 20 and the magnetic device 14. The frictional force in the situation will typically be greater both because there is a reduced or no gap between the magnetic body 20 the magnetic device 14, causing a magnetic force having a greater magnitude to act on the magnetic body 18, and because there is a greater surface area of the magnetic body 18 contacting the magnetic device 14.

Although the discussion above discloses the knob 22 being on the magnetic body 18 and the recess 16 being on the magnetic device 14, the reverse could also be used. Further, more than one knob 22 or recess 14 may be used. Similarly the magnetic body 18 may have both knobs 22 and recesses 14 and the magnetic device 14 may have the appropriate mates for them. In addition, a variety of other shapes known to those skilled in the art may be used for the protrusion(s) and recess(es).

In one embodiment of the invention, a lever arm 24 is coupled with the movable body 18. Thus, the lever arm 24 experiences the varying frictional forces acting on the magnetic body 18.

In one embodiment of the invention, a biasing device, such as a spring or torsional spring 26, is coupled with the magnetic body 18. The torsional spring 26 biases the magnetic body 18 towards a predetermined position, and may be used as a centering device. Typically the biasing exerted by the torsional spring 26 is a lesser magnitude than a frictional force having the second magnitude. Thus, the torsional spring 26 will typically not center the magnetic body 18 when the magnetic body 18 is in the second position, e.g., when the knobs 22 and recesses 14 are mated.

In one embodiment of the invention, a position sensor 28 is coupled with the magnetic body 18. The position sensor 28 may be any of a variety of sensors known to those skilled in the art. The position sensor 28 transmits a position signal ("POS") as a function of the position of the magnetic body 18.

In one embodiment of the invention, a controller 30 or other processing device is coupled with the position sensor 28 to receive the position signal POS. In the embodiments using an electromagnet in the magnetic device 14, the controller 30 may transmit a power signal POWER to the electromagnet as a function of the position signal POS, causing the electromagnet to exert the magnetic force.

In one embodiment of the invention, the controller 30 transmits the power signal POWER when the position signal POS has a first characteristic, such as being between the first and second predetermined values. Further, the controller 30 may not transmit the power signal POWER when the position signal POS has a second characteristic, such as being between a third and fourth predetermined values. Additionally, some degree of hysteresis may be built into the controller by ways known to those skilled in the art depending upon the change in direction of the motion of the magnetic body 18.

For example, the knob 22 may mate with the recess 16 when the magnetic body 18 is rotated 20 degrees clockwise. As the lever arm 24 is rotated clockwise, rotating the magnetic body 18, the electromagnet is initially deenergized. As the lever arm 24 is rotated further, reaching approximately 18 degrees, controller 30 energizes the electromagnet via the power signal POWER. At approximately 20 degrees, the knob 22 is pulled into the recess 16 by the magnetic force exerted on the magnetic body 18, and the lever arm 24 is in a detent position. As the lever arm 24 is rotated counter-clockwise, back towards 0 degrees, the controller 30 may deenergize the electromagnet when the magnetic body 18 reaches the 16-degree position.

In one embodiment of the invention, the controller 30 is operable to receive a flag signal ("FLAG"), and the power signal POWER is transmitted as a function of the flag signal FLAG. The flag signal FLAG may be used as an indicator of a particular condition existing outside of the detent device 10, and the controller 30 may energize or deenergize the electromagnet as a function of the flag signal FLAG.

For example, the detent device 10 may be used as a position controller for device having a maximum range of movement. As the lever arm 24 is rotated clockwise into a detent position, with the knob 22 mated with recess 16 and the electromagnet energized, the device moves towards its maximum range. When the device reaches the maximum range, the device may transmit the flag signal FLAG to the controller 30. The controller 30 then deenergizes the electromagnet as a function of receiving the flag signal FLAG. If the detent device 10 includes the torsional spring 26, the lever arm 24 may be rotated back to its centered position, "kicking" the magnetic body 18 out from the detent position.

In one embodiment in the invention, the magnetic device 14 may include a faceplate 32 made of a material that does not substantially inhibit the magnetic force exerted by the magnetic device 14. The faceplate 32 may then be replaced, e.g., for reasons relating to wear or because different locations for the recesses 16 are desired, without having to replace the entire magnetic device 14.

Although the above discussion discloses the magnetic body 18 as rotating, and other embodiments the magnetic body 18 may translate, e.g., slide, or both rotated and translate, e.g., arcuate motion. Similarly, although the magnetic body 18 is disclosed as being movable, in other embodiments the magnetic body 18 may be stationary and the magnetic device 14 may be movable. In this embodiment, the lever arm 24, the torsional spring 26, and the position sensor 28 may all be coupled with the magnetic device 14, i.e., the moving element.

INDUSTRIAL APPLICABILITY

The detent device 10 may be used in a variety of ways, including on a variety of work machines. For example, the detent device 10 may be used to control the lifting/lowering of a bucket on a wheel loader. In one embodiment of the invention, detents could be positioned at the maximum lift/lower position. An operator could then place the lever arm 24 in the detent position causing the bucket to lift/lower. When the bucket reaches the maximum position, the controller 30 deenergizes the electromagnet, and the lever arm 24 centers, indicating that the maximum position has been reached. The detent device 10 could be used on other work machines also, such as tractors, excavators, pavers, and others known to those skilled in the art, as well as stationary machines with moving parts.

From the foregoing it will be appreciated that, although specific embodiments of the invention have been described herein for purposes of illustration, various modifications may be made without deviating from the spirit or scope of the invention. Accordingly, the invention is not limited except as by the appended claims.

What is claimed is:

1. A detent device, comprising:

a housing;

a magnetic device disposed at least in part within the housing, the magnetic device operable to exert a magnetic force, the magnetic device including a body and one of a recess defined therein and a protrusion; and a magnetic body disposed at least in part within the housing and operable to be biased towards the magnetic device as a function of the magnetic force, the magnetic body including a magnetic mass and the other of the recess defined therein and the protrusion, the other of the protrusion and the recess operable to receive the one of the protrusion and the recess of the magnetic device when the magnetic body is in a first predetermined position relative to the magnetic device, the magnetic mass of the magnetic body being spaced a first predetermined distance from the body of the magnetic device when the magnetic body is in the first predetermined position, and the magnetic mass of the magnetic body being spaced a second predetermined distance from the body of the magnetic device by the protrusion on the one of the magnetic device and the magnetic body when the magnetic body is in a second predetermined position relative to the magnetic device.

2. The detent device of claim 1 wherein the magnetic device and the magnetic body are frictionally coupled when the magnetic body is in the first and second predetermined positions.

3. The detent device of claim 1 wherein the magnetic device and the magnetic body are frictionally coupled with a frictional force having a first magnitude when the magnetic body is in the first predetermined position and having a second magnitude when the magnetic body is in the second predetermined position.

4. The detent device of claim 1 wherein the magnetic device is operable to receive a control signal and the magnetic device is operable to exert the magnetic force as a function of a control signal.

5. The detent device of claim 1, further comprising a position sensor coupled with the magnetic body, the position sensor operable to transmit a position signal as a function of the position of the magnetic body.

6. The detent device of claim 4, further comprising:

a position sensor coupled with the magnetic body, the position sensor operable to transmit a position signal as a function of the position of the magnetic body; and a controller coupled with the position sensor to receive the position signal, the controller operable to transmit the control signal to the magnetic device as a function of the position signal.

7. The detent device of claim 6 wherein the controller is further operable to receive a first condition signal and the control signal is further a function of the first condition signal.

8. The detent device of claim 1, further comprising a biasing device coupled with the magnetic body, the biasing device operable to bias the magnetic device towards a predetermined rotational position.

9. The detent device of claim 8 wherein the biasing device comprises a spring.

10. The detent device of claim 1, further comprising a lever arm coupled with one of the magnetic device and the magnetic body.

11. The detent device of claim 1, wherein the magnetic device further comprises a faceplate, the faceplate having the one of the protrusion and the recess.

12. The detent device of claim 1 wherein the magnetic body comprises a disk.

13. The detent device of claim 1 wherein the magnetic device comprises one of an electromagnet and a permanent magnet.

14. The detent device of claim 1 wherein the recess comprises a dimple.

15. The detent device of claim 1, further comprising a first plurality of one of a protrusion and a recess on the first side of the magnetic device and a first plurality of the other of the protrusion and the recess on the magnetic body, the first plurality of the other of the protrusion and the recess operable to receive the first plurality of the one of the protrusion and the recess of the magnetic device when the magnetic body is in a first predetermined position relative to the magnetic device.

16. The detent device of claim 1 wherein the first predetermined distance comprises zero.

17. The detent device of claim 1 wherein the second predetermined distance comprises the distance the protrusion protrudes from the one of the magnetic device and the magnetic body.

18. A method for varying the resistance to movement of a magnetic body relative to a magnetic device, comprising:

exerting a magnetic force on the magnetic body with the magnetic device, the magnetic force biasing the magnetic body towards the magnetic device;

frictionally coupling the magnetic body with the magnetic device; and adjusting the distance between the magnetic body and the magnetic device between a first distance and a second distance as a function of the rotational position of the magnetic body with the magnetic device.

19. The method of claim 18, wherein frictionally coupling the magnetic body with the magnetic device comprises:

frictionally coupling the magnetic body and the magnetic device with a frictional force having a first magnitude when the magnetic body is in a first predetermined position; and frictionally coupling the magnetic body and the magnetic device with a frictional force having a second magnitude when the magnetic body is in a second predetermined position.

* * * * *